United States Patent [19]

Tamagawa et al.

[11] Patent Number: 4,762,816

[45] **Date of Patent: * Aug. 9, 1988**

[54] HEAT-SENSITIVE RECORDING PAPER

[75] Inventors: Shigehisa Tamagawa; Tetsuro Fuchizawa, both of Shizuoka, Japan

[73] Assignee: Fuji Photo Film Co., Ltd., Minami-ashigara, Japan

[ * ] Notice: The portion of the term of this patent subsequent to Jan. 28, 2003 has been disclaimed.

[21] Appl. No.: 750,950

[22] Filed: Jul. 2, 1985

[30] Foreign Application Priority Data

Jul. 2, 1984 [JP] Japan ..... 59-136975

[51] Int. Cl.[4] ..... B41M 5/18

[52] U.S. Cl. ..... 503/200; 427/150; 427/151; 428/342; 428/409; 428/537.5; 503/226

[58] Field of Search ..... 346/200, 226; 427/150–152; 428/537.5, 342, 409; 503/200, 207, 226

[56] References Cited

U.S. PATENT DOCUMENTS

| | | | |
|---|---|---|---|
| 4,069,353 | 1/1978 | Matsukawa et al. | 427/150 |
| 4,411,452 | 10/1983 | Miyamoto | 428/537.5 |
| 4,567,496 | 1/1986 | Ogata et al. | 428/537.5 |
| 4,567,497 | 1/1986 | Tamagawa et al. | 428/537.5 |

FOREIGN PATENT DOCUMENTS

| | | | |
|---|---|---|---|
| 0071196 | 4/1983 | Japan | 346/200 |
| 0069091 | 4/1983 | Japan | 346/200 |
| 2111701A | 7/1983 | United Kingdom | 346/200 |

*Primary Examiner*—Bruce H. Hess

*Attorney, Agent, or Firm*—Sughrue, Mion, Zinn, Macpeak & Seas

[57] ABSTRACT

A heat-sensitive recording paper is disclosed, comprising a paper support with a heat-sensitive color forming layer provided thereon, wherein the paper support has an internal bonding force of from 0.5 to 2.0 kg·cm and a cobb water absorption of 10 to 20 g/m$^2$. This recording paper avoids problems of sticking and piling, and is very suitable for use in high speed recording.

11 Claims, No Drawings

HEAT-SENSITIVE RECORDING PAPER

FIELD OF THE INVENTION

The present invention relates to a heat-sensitive recording paper for use in recording with a thermal head or thermal pen, for example. More particularly, it is concerned with a heat-sensitive recording paper which avoids problems such as "sticking" of a heat-sensitive color forming layer to the thermal head, and "piling" on the thermal head, and which is superior in dot reproductivity and permits sharp and high density recording even in high speed recording.

BACKGROUND OF THE INVENTION

In recent years marked advances have been made in facsimile equipment, printers, etc. In these devices a heat-sensitive recording system using a combination of a heat-sensitive recording paper with a colorless dye such as crystal violet lactone and a phenol compound coated thereon and a thermal head as described in Japanese Patent Publication No. 14039/70 (corresponding to U.S. Pat. No. 3,539,375 and British Patent No. 1,135,540) is widely used.

This heat-sensitive recording system has many advantages. For example, since the recording paper is of the primary coloration type, a developing process is not needed and the recording equipment can be simplified, the recording paper and recording equipment are inexpensive, and since the recording system is of the non-impact type, it does not produce noise. Thus, the heat-sensitive recording system has established its position as a low speed recording system.

The heat-sensitive recording system, however, has a disadvantage in that its recording speed is lower than those of other recording systems, such as electrostatic recording. For this reason it has not yet been employed in high speed recording.

The major reason why high speed recording can not be achieved by the heat-sensitive recording system is that heat conduction between the thermal head and the heat-sensitive recording paper cannot be attained sufficiently and thus a sufficiently high recording density cannot be obtained. The thermal head is a bundle of dot shaped electric resistance heat generators and, upon receipt of a recording signal, generates heat and melts the heat-sensitive color forming layer in contact therewith, thereby allowing the layer to form color. In order to obtain sharp and high density records, it is necessary that dot reproductivity be high. That is, the thermal head and heat-sensitive color forming layer should be brought into as close a contact as possible so that heat conduction is carried out efficiently and on the heat-sensitive color forming layer thoroughly colored dots are formed in full agreement with a high speed recording signal and also with the shape of the dot shaped heat generator. Actually, however, only several percent of the amount of energy generated by the thermal head is conducted to the heat-sensitive color forming layer, and the efficiency of heat conduction is undesirably low.

Several methods have been proposed to increase the smoothness of the heat-sensitive color forming layer so as to bring the thermal head and heat-sensitive color forming layer into as close a contact as possible with each other.

Japanese Patent Publication No. 20142/77, for example, discloses a method of treating the surface of the heat-sensitive color forming layer so that the Beck smoothness is from 200 to 1,000 seconds. Japanese Patent Application (OPI) No. 115255/79 (the term "OPI" as used herein refers to a "published unexamined Japanese patent application open to public inspection") discloses that if the Beck smoothness is from 200 to 1,000 seconds, the heat-sensitive color forming layer can correspond to heat pulses of only about 5 to 6 milliseconds. Therefore, it is necessary that in the case of high speed recording of 1 millisecond or less the surface of the heat-sensitive color forming layer be smoothed to an extent that the Beck smoothness is 1,100 seconds or more. If, however, the Beck smoothness is increased to more than 1,100 seconds, color fog is formed by the action of pressure. For this reason, in order to prevent the formation of such color fog, the smoothness of an original paper (base paper) to be used is generally increased to an extent that the Beck smoothness is 500 seconds or more. Japanese Patent Application (OPI) No. 156086/80 discloses that the surface roughness (Ra) of the heat-sensitive color forming layer is decreased to 1.2 μm or less, and the glossiness is adjusted to 25% or less.

In accordance with the conventional methods, the smoothness of the heat-sensitive color forming layer has been increased only by application of calendering techniques such as supercalendering, machine calendering, and gloss calendering. This calendering is applied on the base paper alone, or both the base paper and the heat-sensitive paper, or the heat-sensitive paper alone. In the heat-sensitive recording paper, as the smoothness is increased, the recording density increases, but on the other hand, sticking and piling also increase. Therefore, the recording density and the sticking and piling are balanced appropriately by controlling the smoothness to a suitable level. With the conventional heat-sensitive recording papers, even if the smoothness is controlled to any level, they are not suitable for use in high speed recording in both recording density and recording stability.

The term "sticking" as used herein refers to a phenomenon wherein the thermal head sticks to the heat-sensitive color forming layer; therefore, noise is generated when they are separated, and the dot reproductivity is decreased. The term "piling" refers to a phenomenon wherein materials resulting from heat melting of the heat-sensitive color forming layer deposit on the thermal head, thereby decreasing the recording density and dot reproductivity. Both the phenomena interfere with stabilized recording.

Another disadvantage of the application of the calendering onto the heat-sensitive recording paper is that color fog is formed by the action of pressure and the density of the background of the recording paper is increased. Also, the calendering of the base paper is limited in that so-called cockles wrinkles, etc., are formed owing to an unevenness in basis weight.

As described above, smoothing the heat-sensitive color forming layer by application of calendering and increasing the recording density are necessarily limited, and heat-sensitive recording papers fully satisfactory for high speed recording not yet been obtained.

SUMMARY OF THE INVENTION

The present invention is intended to overcome the above problems, and an object of the present invention is to provide a heat-sensitive recording paper which is superior in dot reproductivity and permits high density recording.

It has been found that the above object can be attained by using a paper support in which two characteristics, i.e., an internal bonding force showing compressibility and a cobb water absorption showing sizing properties, are adjusted to certain optimum values. That is, it has been found that the heat-sensitive recordiing paper superior in dot reproductivity and realizing high density recording can be obtained by using a paper support in which the internal bonding force (as defined by Tappi Useful Method-528 which is a revision of Tappi RC-308) is from 0.5 to 2.0 kg·cm, preferably 1.0 to 1.5 kg·cm, and the cobb water absorption (as defined by JIS-P-8140) is from 10 to 20 g/m$^2$, preferably 15 to 20 g/m$^2$.

The present invention relates to a heat-sensitive recording paper comprising a paper support with a heat-sensitive color forming layer provided thereon, wherein the paper support has an internal bonding force (as determined by Tappi Useful Method-528) of from 0.5 to 2.0 kg·cm and a cobb water absorption (according to Cobb Test (testing method for water absorptiveness of paper) as determined by JIS P-8140) of from 10 to 20 g/m$^2$.

DETAILED DESCRIPTION OF THE INVENTION

The internal bonding force falling within the range as specified in the present invention can be obtained by suitably controlling two factors: raw materials and paper making conditions. These raw materials include (1) pulp, (2) a pigment, (3) a softening agent, (4) a paper strength reinforcing agent, and (5) a surface sizing agent. The paper making conditions include (1) the type of a beating machine and a degree of beating, (2) wet pressing conditions, and (3) drying conditions.

If the internal bonding force is less than 2.0 kg·cm, a sufficiently high recording density can be obtained. However, if it is less than 0.5 kg·cm, undesirable problems such as tearing arise during the production of paper, and furthermore, the ultimate heat-sensitive recording paper is undesirably poor in stiffness, etc.

The cobb water absorption falling within the range as specified in the present invention can be obtained by suitably controlling the type and amount of each of raw materials such as an inner addition sizing agent, a softening agent, a fixing agent, and a surface sizing agent.

If the cobb water absorption is less than 20 g/m$^2$, the surface smoothness is less reduced during the coating of the heat-sensitive coating solution. Therefore, during heat-sensitive recording, the recording density is high and the dot reproductivity is good. However, if the cobb water absorption is less than 10 g/m$^2$, the wettability of the heat-sensitive coating solution to the paper support is deteriorated. Thus, when the heat-sensitive coating solution is coated at high speed, small partially uncoated areas are formed. This is undesirable for practical use.

As described above, the desired recording density and dot reproductivity can be obtained by controlling the cobb water absorption and internal bonding force of the paper support within the above specified ranges.

The paper support as used herein is preferably made mainly from wood pulp. Synthetic fibers or synthetic pulp may be used partially in combination with the wood pulp. As the wood pulp, either of needle leaf tree pulp and broad leaf tree pulp can be used. Preferably, broad leaf tree pulp composed of short fibers and capable of producing smoothness constitutes at least 60 wt % of the wood pulp. The freeness of the pulp is preferably nearly in the state that it is not beaten from the viewpoint of the internal bonding force. From the viewpoint of paper making suitability, however, it is desirably from 300 to 500 cc (C.S.F.).

Various additives can be added. For example, as sizing agents to improve sizing properties, rosin, paraffin wax, higher fatty acid salts, alkenylsuccinic acid salts, fatty acid anhydrides, alkyl ketene dimers, and so forth can be used. As softening agents which are more effective to decrease the internal bonding force, reaction products of maleic anhydride copolymers and polyalkylenepolyamine are preferably used. In addition, if desired, fillers such as clay, talc, calcium carbonate, and powdered urea/formalin resin, and fixing agents such as alumina sulfate and polyamidepolyamine epichlorohydrin can be added. Furthermore, the back of the base paper may be provided with a curl preventing layer of latexes of SBR (Styrene Butadiene Rubber), MBR (Methyl Methacrylate Butadiene Rubber), and so forth, or water-soluble polymers such as starch and PVA (Polyvinyl Alcohol).

As the paper support used in the present invention, the support, which is subjected to a smoothing treatment by means of machine calendering, gloss calendering, supercalendering, etc., during and/or after paper making, can be used. The Beck smoothness (as determined by JIS P-8119) of the supports is preferably about 200 seconds or more, more preferably 250 seconds or more.

A heat-sensitive coating solution, which is a solution to be applied to form a heat-sensitive color forming layer, will hereinafter be explained.

In accordance with the general procedure to prepare the heat-sensitive coating solution, a color former and a developer are first dispersed separately in a water-soluble polymer solution by means of a ball mill, for example. In the case of the ball mill, balls having varied diameters are used in a suitable mixing ratio and the color former and developer are each dispersed over a long period of time to thereby form finely divided dispersions. In addition, a model sand mill (trade name: Dyno Mill) and so forth can be effectively used.

The color former and developer dispersion thus prepared are mixed, and an inorganic pigment, waxes, higher fatty acid amides, metallic soap, and, if desired, an ultraviolet ray absorber, an antioxidant, a latex based binder, and so forth are added to prepare the desired coating solution. Of course, these additives may be added during the dispersion process.

The heat-sensitive coating solution is generally coated on the paper support so that the amount of the color former coated is from 0.2 to 1.0 g/m$^2$.

The color former as used herein is not critical. Any color formers commonly used in conventional pressure-sensitive and heat-sensitive recording papers can be used in the present invention. Representative examples of the color former are set forth below.

(1) Triarylmethane based compounds:

3,3-Bis(p-dimethylaminophenyl)-6-dimethylaminophthalide (Crystal Violet Lactone), 3-(p-dimethylaminophenyl)-3-(1,2-dimethylindole-3-yl)phthalide, 3-(p-dimethylaminophenyl)-3-(2-phenylindole-3-yl)phthalide, 3,3-bis(p-ethylcarbazole-3-yl)-3-dimethylaminophthalide, 3,3-bis(2-phenylindole-3-yl)-5-dimethylaminophthalide, etc.

(2) Diphenylmethane based compounds:

4,4-Bisdimethylaminobenzhydrin benzyl ether, N-halophenylleucoauramine, N-2,4,5-trichlorophenylleucoauramine, etc.

(3) Xanthene based compounds:

Rhodamine B-anilinolactam, 3-diethylamino-7-dibenzylaminofluoran, 3-diethylamino-7-butylaminofluoran, 3-diethylamino-7-(2-chloroanilino)fluoran, 3-diethylamino-6-methyl-7-anilinofluoran, 3-piperidino-6-methyl-7-anilinofluoran, 3-ethyltolylamino-6-methyl-7-anilinofluoran, 3-cyclohexylmethylamino-6-methyl-7-anilinofluoran, 3-diethylamino-6-chloro-7-(β-ethoxyethyl)aminofluoran, 3-diethylamino-6-chloro-7-(γ-chloropropyl)aminofluoran, 3-diethylamino-6-chloro-7-anilinofluoran, 3-N-cyclohexyl-N-methylamino-6-methyl-7-anilinofluoran, 3-diethylamino-7-phenylfluoran, etc.

(4) Thiazine based compounds:

Benzoyl Leucomethylene Blue, p-nitrobenzoyl Leucomethylene Blue, etc.

(5) Spiro based compounds:

3-Methyl-spiro-dinaphthopyran, 3-ethyl-spirodinaphthopyran, 3-benzyl-sprio-dinaphthopyran, 3-methylnaphtho(3-methoxybenzo)spiropyran, etc.

These compounds can be used as mixtures comprising two or more thereof.

The color former is chosen depending on the use and the desired characteristics.

Preferred examples of the developer that is used in the present invention are phenol derivatives and aromatic carboxylic acid derivatives. Particularly preferred are bisphenols. In more detail, as phenol derivatives, p-octylphenol, p-tert-butylphenol, p-phenylphenol, 2,2-bis(p-hydroxy)propane, 1,1-bis(p-hydroxy phenyl)pentane, 1,1-bis(p-hydroxyphenyl)hexane, 2,2-bis(p-hydroxyphenyl)hexane, 1,1-bis(p-hydroxyphenyl)-2-ethylhexane, and 2,2-bis(4-hydroxy-3,5-dischlorophenyl)propane can be used.

Aromatic carboxylic acid derivatives which can be used include p-hydroxybenzoic acid, propyl p-hydroxybenzoate, butyl p-hydroxybenzoate, benzyl p-hydroxybenzoate, 3,5-di-α-methylbenzylalicyclic acid, and the polyvalent metal salts of the above carboxylic acids.

The developer is preferably added in one of the following two manners. One is to add the developer as an eutectic mixture with a heat fusible substance having a low melting point so that the developer melts at a predetermined temperature and undergoes a color forming reaction. The other is to add the developer in the state such that a low melting compound, such as those described below, is fused to the surface of developer grains.

Waxes which can be used include paraffin wax, carnauba wax, microcrystalline wax, polyethylene wax, and higher fatty acid amides such as stearic acid amide, ethylenebisstearoamide, and higher fatty acid esters.

Metallic soaps which can be used include the polyvalent metal salts of higher fatty acids, such as zinc stearate, aluminum stearate, calcium stearate and zinc oleate.

Inorganic pigments which can be used include kaolin, calcined kaolin, talc, agalmatolite, diatomaceous earth, calcium carbonate, aluminum hydroxide, magnesium hydroxide, magnesium carbonate, titanium oxide, and barium carbonate.

For these inorganic pigments is preferred that the oil absorption amount is 60 ml/100 g or more and the average grain diameter is 5 μm or less. It is preferred for oil absorbing inorganic pigments to be added so that the amount (dry basis) of the pigment in the recording layer is from 5 to 50 wt % and preferably from 10 to 40 wt %.

These compounds are dispersed in a binder and coated. Binders which are commonly used for this purpose include water-soluble binders such as polyvinyl alcohol, hydroxyethyl cellulose, hydroxypropyl cellulose, an ethylene/maleic anhydride copolymer, a styrene/maleic anhydride copolymer, an isobutylene/maleic anhydride copolymer, polyacrylic acid, starch derivatives, casein and gelatin.

For the purpose of providing the binder with water resistance, compounds to make the binder water resistant (e.g., a gelling agent and a cross-linking agent), or emulsions of hydrophobic polymers, such as a styrene/butadiene rubber latex, and an acryl resin emulsion can be added.

The amount (dry basis) of the binder in the recording layer is generally from 10 to 30 wt %. In addition, if desired, various aids such as a defoaming agent, a fluorescent agent, and a coloring dye can be added to the coating solution.

The heat-sensitive coating solution is coated on the paper support by known coating techniques such as blade coating, air knife coating, gravure coating, roll coating, spray coating, dip coating, bar coating and extrusion coating.

The amount of the coating solution being coated on the paper support is not critical. Usually the amount (dry basis) of the coating solution coated is from 3 to 15 $g/m^2$, and preferably from 4 to 10 $g/m^2$.

With the heat-sensitive recording paper of the present invention prepared using a paper support having an internal bonding force and a cobb water absorption both falling within the above specified ranges, the contact area between the heat-sensitive color forming layer and thermal head during recording is increased, and high recording density and good dot reproductivity can be obtained.

The present invention is described in greater detail with reference to the following example, although it is not limited thereto.

EXAMPLE

By choosing the pulp, freeness, sizing agent and softening agent as shown in Table 1, paper supports having an internal bonding force and a cobb water absorption as shown in Table 1 were prepared. In each paper support, a Fourdrinier paper machine was used, and the basis weight was 50 $g/m^2$ and the thickness was 60 um.

A heat-sensitive coating solution was coated on each paper support to prepare a heat-sensitive recording paper. This heat-sensitive recording paper was subjected to heat recording, and the recording density was measured. The results are shown in Table 2.

A method for preparation of the heat-sensitive coating solution, a method for coating the coating solution, and a method for measuring the recording density are shown below.

Heat-Sensitive Coating Solution 20 kg of Crystal Violet Lactone was dispersed in a 10% aqueous solution of polyvinyl alcohol (degree of saponification: 98%; degree of polymerization: 500) in a 300 liter ball mill for about 24 hours. Similarly, 20 kg of 2,2-bis(4-hydroxyphenyl)propane was dispersed in a 10% aqueous solution of polyvinyl alcohol in a 300 liter ball mill for about 24 hours.

The dispersions thus prepared were mixed in such a manner that the weight ratio of Crystal Violet Lactone to 2,2-bis(4-hydorxyphenyl)propane was 1/5. Then, 5 kg of precipitated calcium carbonate was added to 20 kg of the above obtained mixture and thoroughly dispersed therein to prepare the desired coating solution.

Coating of Heat-Sensitive Coating Solution

The heat-sensitive coating solution was coated with an air knife coater on one side of the paper support in an amount (solids basis) of 6 g/m$^2$, dried in a 50° C. hot air drier, and then was subjected to machine calendering.

Measurement of Recording Density

Solid coloration was conducted under the following conditions.

Recording speed: 2 milliseconds per dot

Recording density:

in main scanning direction: 5 dots/mm in sub-scanning direction: 6 dots/mm

Energy of the thermal head: 50 millijoule/mm$^2$

As the recording density, the reflective density at 610 nm was measured.

TABLE 1

| Run No. | Pulp (wt %) | Freeness (cc) | Sizing Agent* (%) | Softening Agent* (%) | Internal Bonding Force (kg · cm) | Water Absorption (g/m$^2$) | Beck Smoothness (sec) |
|---|---|---|---|---|---|---|---|
| Example 1 | LBKP (100) | 500 | Alkylketene dimer (0.3) | — | 1.60 | 15.7 | 254 |
| Example 2 | LBKP (100) | 400 | Alkylketene dimer (0.3) | Maleic anhydride based (0.1)** | 0.98 | 14.9 | 402 |
| Example 3 | LBKP (100) | 400 | Alkenyl succinate (1.2) | Maleic anhydride based (0.1) | 1.55 | 17.5 | 274 |
| Example 4 | LBKP (100) | 350 | Alkenyl succinate (1.2) | Maleic anhydride based (0.2) | 1.20 | 18.0 | 387 |
| Example 5 | LBKP/NBKP (80/20) | 350 | Alkenyl succinate (1.2) | Maleic anhydride based (0.2) | 1.39 | 17.4 | 312 |
| Comparative Example 1 | LBKP (100) | 320 | Alkylketene dimer (0.3) | — | 2.71 | 18.2 | 114 |
| Comparative Example 2 | LBKP/NBKP (20/80) | 320 | Rosin (0.3) | Maleic anhydride (0.1) | 1.90 | 38.5 | 165 |
| Comparative Example 3 | NBKP (100) | 260 | Rosin (0.3) | — | 5.10 | 40.3 | 98 |

Note:
"LBKP" refers to Laubholz (hard wood) Bleeched Kraft Pulp.
"NBKP" refers to Nadelholz (soft wood or needle leaf tree) Bleeched Kraft Pulp.
*Weight percent based on the weight of the pulp.
**Reaction product of a maleic anhydride copolymer and polyalkylenepolyamine.

TABLE 2

| Run No. | Recording Density | Dot Reproductivity |
|---|---|---|
| Example 1 | 0.95 | Excellent |
| Example 2 | 1.03 | " |
| Example 3 | 0.91 | " |
| Example 4 | 1.00 | " |
| Example 5 | 0.94 | " |
| Comparative Example 1 | 0.78 | Good |
| Comparative Example 2 | 0.84 | " |
| Comparative Example 3 | 0.69 | Poor |

It can be seen from the results of Table 2 that the heat-sensitive recording papers of the present invention are superior in both recording density and dot reproductivity to the comparative recording papers.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a paper support with a heat-sensitive color forming layer provided thereon, wherein the paper support has an internal bonding force (as determined by Tappi Useful Method-528) of from 0.5 to 2.0 kg·cm, a cobb water absorption (as determined by JIS P-8140) of from 10 to 20 g/m$^2$ and is prepared with a reaction product of maleic anhydride copolymers and polyalkyenepolyamine as a softening agent.

2. A heat-sensitive recording paper as in claim 1, wherein at least 60 wt % of the pulp used in the preparation of the paper support is broad leaf tree bleached pulp.

3. A heat-sensitive recording paper as in claim 2, wherein the freeness of the pulp is from 300 to 500 cc (CSF).

4. A heat-sensitive recording paper as in claim 1, wherein the Beck smoothness (as determined by JIS P-8119) of said paper support is 200 seconds or more.

5. A heat-sensitive recording paper as in claim 1, wherein the internal bonding force is from 1.0 to 1.5 kg·cm.

6. A heat-sensitive recording paper as in claim 1, wherein the cobb water absorption is from 15 to 20 g/m$^2$.

7. A heat-sensitive recording paper as in claim 1, wherein the support is prepared using a sizing agent selected from the group consisting of rosin, paraffin wax, higher fatty acid salts, alkenylsuccinic acid salts, fatty acid anhydrides and alkyl ketene dimers.

8. A heat-sensitive recording paper as in claim 1, wherein the support is prepared using a filler selected from the group consisting of clay, talc, calcium carbonate and powdered urea/formalin resin.

9. A heat-sensitive recording paper as in claim 1, wherein the support is prepared using a fixing agent selected from the group consisting alumina sulfate and polyamidepolyamine epichlorohydrin.

10. A heat-sensitive recording paper as in claim 9, wherein the fixing agent is polyamidepolyamine epichlorohydrin.

11. A heat-sensitive recording paper as in claim 1, wherein the heat-sensitive color forming layer contains a color former and is coated on the paper support in an amount such that the amount of the color former coated is from 0.2 to 1.0 g/m$^2$.

* * * * *